US005992958A

United States Patent [19]

Scheible

[11] Patent Number: 5,992,958

[45] Date of Patent: Nov. 30, 1999

[54] DRAWER

[75] Inventor: Adolf Scheible, Lauterach, Austria

[73] Assignee: Grass GmbH, Austria

[21] Appl. No.: 09/065,348

[22] Filed: Apr. 23, 1998

[51] Int. Cl.[6] ..... A47B 88/00

[52] U.S. Cl. ..... 312/348.2; 312/330.1; 403/231

[58] Field of Search ..... 312/348.2, 263, 312/348.1, 348.4, 330.1; 403/407.1, 409.1, 321, 322, 231

[56] References Cited

U.S. PATENT DOCUMENTS

| | | | |
|---|---|---|---|
| 4,664,548 | 5/1987 | Brinkmann | 403/231 X |
| 5,364,181 | 11/1994 | Scheible | 312/348.4 |
| 5,538,339 | 7/1996 | Rock et al. | 312/348.2 X |
| 5,556,183 | 9/1996 | Brustle et al. | 312/348.1 |
| 5,611,637 | 3/1997 | Brustle et al. | 403/409.1 X |
| 5,743,608 | 4/1998 | Johannes | 312/348.2 X |
| 5,823,650 | 10/1998 | Lin | 312/348.2 X |

FOREIGN PATENT DOCUMENTS

| | | | |
|---|---|---|---|
| 429428 | 5/1991 | European Pat. Off. . | |
| 2702217 | 7/1978 | Germany | 312/348.2 |
| 3805669 | 9/1988 | Germany . | |
| 2169491 | 7/1986 | United Kingdom | 312/348.1 |
| WO 97/16090 | 5/1997 | WIPO . | |

*Primary Examiner*—Peter M. Cuomo
*Assistant Examiner*—James O. Hansen
*Attorney, Agent, or Firm*—John M. Harrington; Kilpatrick Stockton LLP

[57] ABSTRACT

The invention is a drawer with Zargen drawer slide system. The side walls of the drawer are simultaneously the Zargen drawer slides, and the Zargen drawer slide system has horizontal flanges that support and hold the drawer bottom. There are fastening devices on the Zargen drawer that connect the Zargen drawer together with the drawer bottom. These fastening devices take the form of latch connectors, which are anchored, swinging, in the Zargen drawer slide system and can be engaged or disengaged manually with the corresponding notches in the drawer bottom.

6 Claims, 4 Drawing Sheets

DRAWER

FIELD OF THE INVENTION

This invention pertains to a drawer, and more particularly to a latch connector for a drawer bottom.

BACKGROUND OF THE INVENTION

A drawer of a similar type was made known by DE-A-38 05 669. The drawer has a metallic Zargen drawer slide system, whose vertical member forms the side of the drawer, and under each one is a horizontal member on which the drawer bottom fits. Hooks, which project into the corresponding notches on the bottom panel, are pressed out of the Zargen drawer slide system's horizontal members. The hooks can be bent with the appropriate tool and are anchored in the notch's panel, connecting the bottom panel securely with the Zargen drawer slide system.

Publication EP-A-0 429 428, likewise, makes known a metallic Zargen drawer slide system that has support flanges on which the drawer bottom fits. Holding tabs are pressed from the support flanges. Grooves are located in the holding tabs to engage the drawer bottom. Here, again, the holding tabs can be bent with the appropriate tool, so that they can dig into the groove's flanks and securely connect the drawer bottom to the Zargen drawer slide system.

The connection, previously made known, between the Zargen drawer slide system and the drawer bottom has the disadvantage that the assembly (especially the insertion of the bottom panel) requires an appropriate tool. Another disadvantage is that once the connection is made between the Zargen drawer slide system and the drawer bottom, it is impossible or difficult to undo the connection without great effort and expense or without the connection components being damaged.

SUMMARY OF INVENTION

The object of the present invention is based on the task of further developing and improving the drawer so that the drawer can be assembled more easily and can be disassembled without tools being required.

A fundamental feature of the invention is the secure connection between the Zargen drawer slide system and the drawer bottom that is achieved by means of several latch connectors. These latch connectors are located in the corresponding notches made for this purpose in the Zargen drawer slide system. These latch connectors can also be released from these notches. These latch connectors are not a fixed component part of the Zargen drawer slide system, but are first inserted in the notches during the final assembly stages. So in this known way, the drawer bottom is inserted into the corresponding retainers of the Zargen drawer slide system; the clasp mechanism of the latch connector engages the drawer bottom in a firm connection.

The advantage of this present invention is that no tools are needed to connect the Zargen drawer slide system to the drawer bottom. The Zargen drawer slide system and drawer can also be disconnected and disassembled at any time without tools.

Another advantage is that the Zargen drawer slide system, other than the notches into which the latch connectors engage, requires no additional means of connection. This simplifies the Zargen drawer slide system's assembly greatly. And, contrary to the previously known technology, the Zargen drawer slide system must not necessarily be made of metal, but can also, for example, be made of plastic.

The latch connectors are made separately out of metal or plastic components, which, for example, can be produced by simple techniques such as injection molding.

BRIEF DESCRIPTION OF THE DRAWINGS

The invention at hand will be explained more precisely by the various embodiments shown by the representational drawings. Hereby, additional significant features and advantages of the invention will be concluded from the drawings and their descriptions.

DETAILED DESCRIPTION

Figure 1:
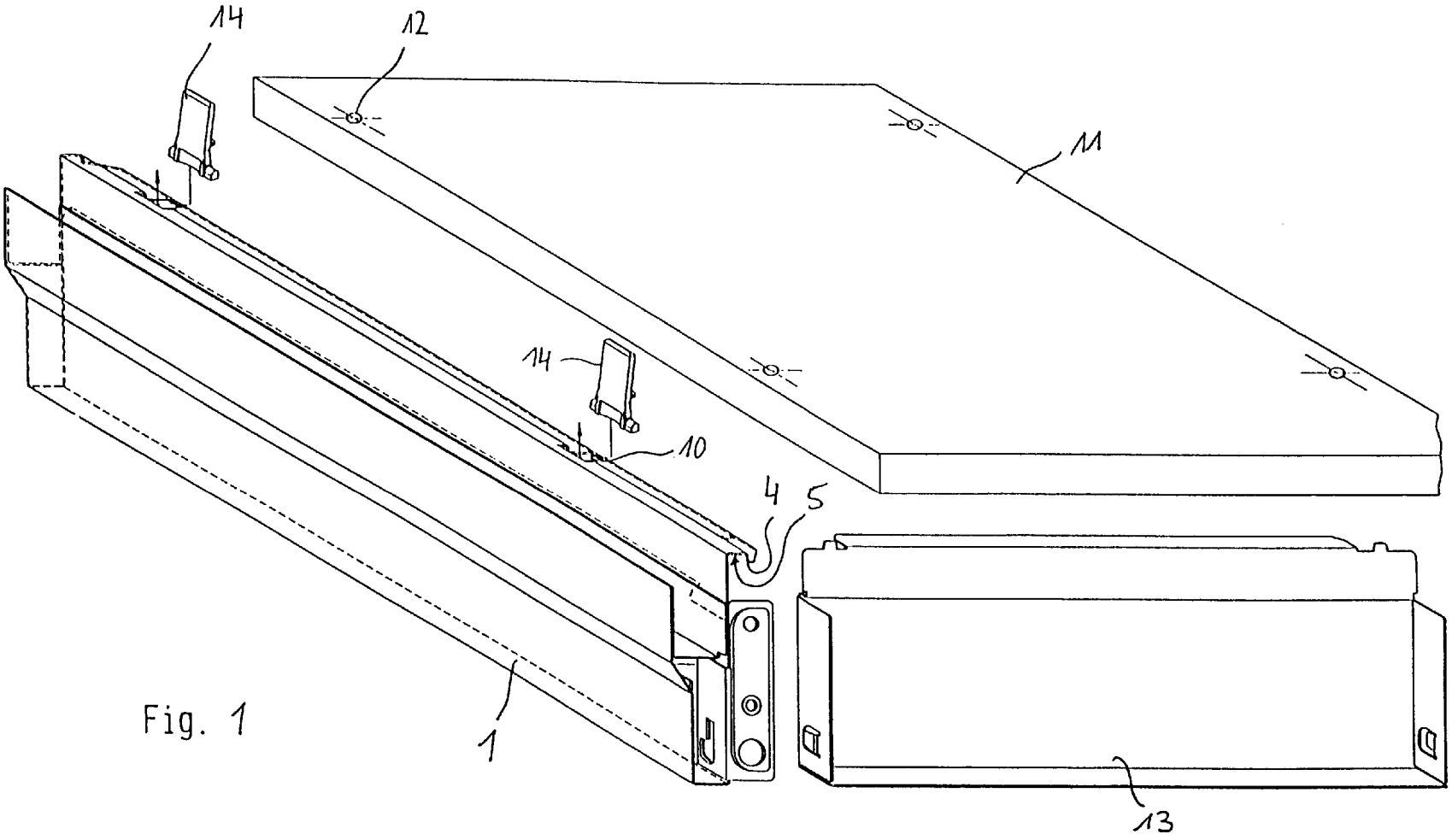
FIG. 1: shows a view of the correct assembly layout of the basic drawer components from below.
Figure 2:
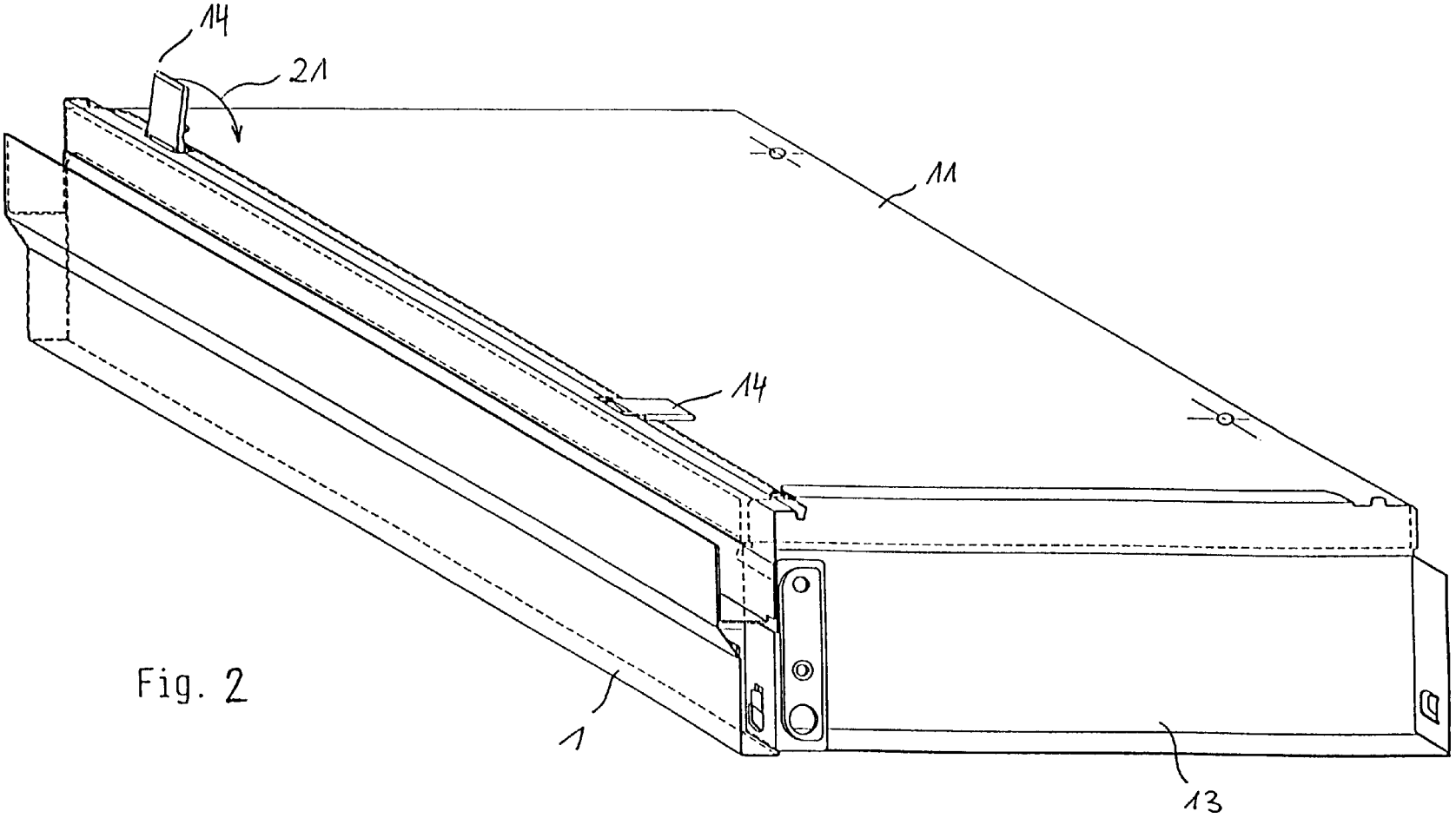
FIG. 2: shows a view of the nearly complete assembly of the drawer from below.

FIG. 1 shows the ready-to-assemble layout of the drawer's fundamental components. Let it be clearly understood that only one of both Zargen drawer slide is embodied and described; however, the following embodiments are analogously valid for both Zargen drawer slides. The drawer's front panel is not represented.

In is understood that references to Zargen, a commercially available drawer slide system, in connection with an embodiment of the present invention, are intended to be representative only. An embodiment of the present invention is not limited to use with a drawer slide system or with a particular type of drawer slide system, and references to Zargen drawer slide system are not intended to limit the scope of the present invention.

The drawer includes the Zargen drawer slide system (1), which is simultaneously the side wall and the slide rails of the drawer. As an example, the Zargen drawer slide system (1) is a two-piece concealed Zargen drawer slide system, which is described more closely below.

The Zargen drawer slide system (1) retains the drawer bottom (11); the ends of the Zargen drawer slide system (1) can be connected to the back panel (13) and a drawer front panel (not shown).

In the support flange (4) area, two or more notches (10) are provided for the drawer bottom (11); notches into which the corresponding latch connectors (14) are inserted.

When the drawer bottom (11) is firmly engaged in the Zargen drawer slide system (1), the dowel plugs (16) (FIG. 3) on the latch connectors (14) work together with the corresponding blind holes (12) in the drawer bottom (11). By rotating the latch connector (14) in the arrow direction (21), a secure connection between the Zargen drawer slide system (1) and the drawer bottom (11) is achieved.

Figure 3:
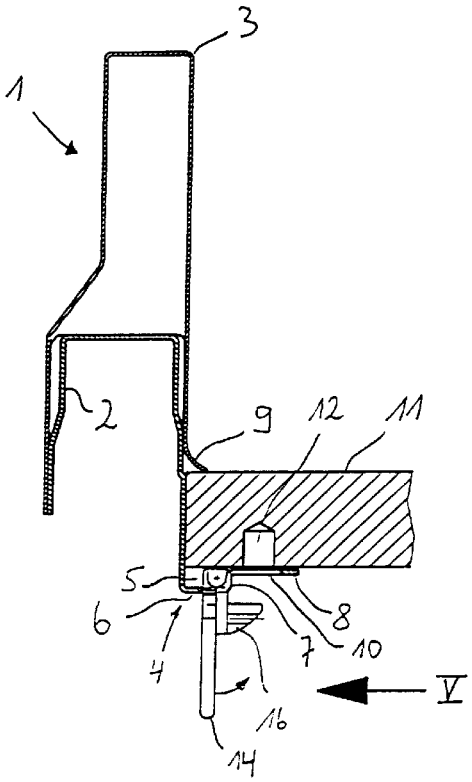
FIG. 3: shows a cross section of the Zargen drawer slide system on the drawer before the drawer bottom is attached.
Figure 4:
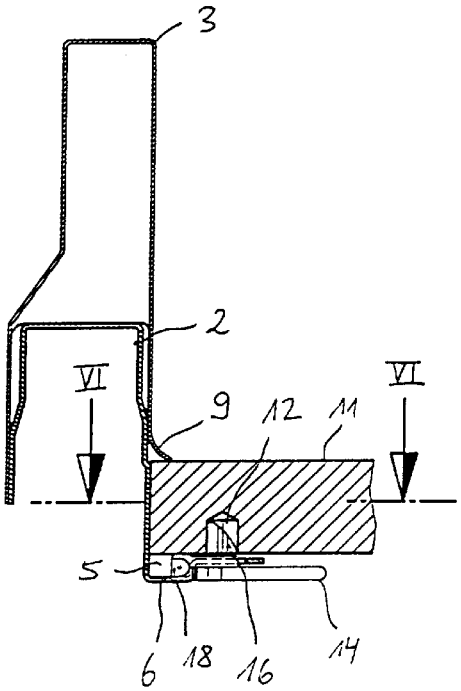
FIG. 4: shows a cross section of the Zargen drawer slide system on the drawer after the drawer bottom has been attached.

This emerges more clearly from FIGS. 3 to 6. FIGS. 3 and 4 show a section of Zargen drawer slide system's (1) area in the drawer. The two-piece embodied Zargen drawer slide system (1) can be recognized with an outer Zargen slide component (3) and an inner Zargen slide component (2). On the drawer's inner corresponding side, the outer Zargen slide component (3) ends with a lip (9). The inner Zargen slide component (2) continues on downward and ends with a Z-shaped flange (4), a horizontal section (6) and, subsequently, a vertical section (7), which forms a horizontal supporting flange (8) on its end, for the drawer bottom (11). Between the lip (9) and the supporting flange (8), a receptacle space is formed into which the drawer bottom (11) can be securely inserted. The lip (9) lies on the upper side of the drawer bottom (11) when the drawer bottom is inserted, and the drawer bottom lies on the supporting flange (8).

Before the drawer bottom is inserted, the latch connector is placed (as seen in FIG. 1) through a notch (10) in the flange (4). The notch (10) is sized exactly so the latch connector's (14) handle (15) fits exactly in it. The latch connector (14), itself, however, is held by the corresponding axle journal (18) in the groove (5) formed in the flange (4). The latch connector (14) is now held captive underneath the inserted drawer bottom, and is additionally supported by the resilient clips (17), which are supported on the flange's (4) horizontal section (6).

Figure 7:
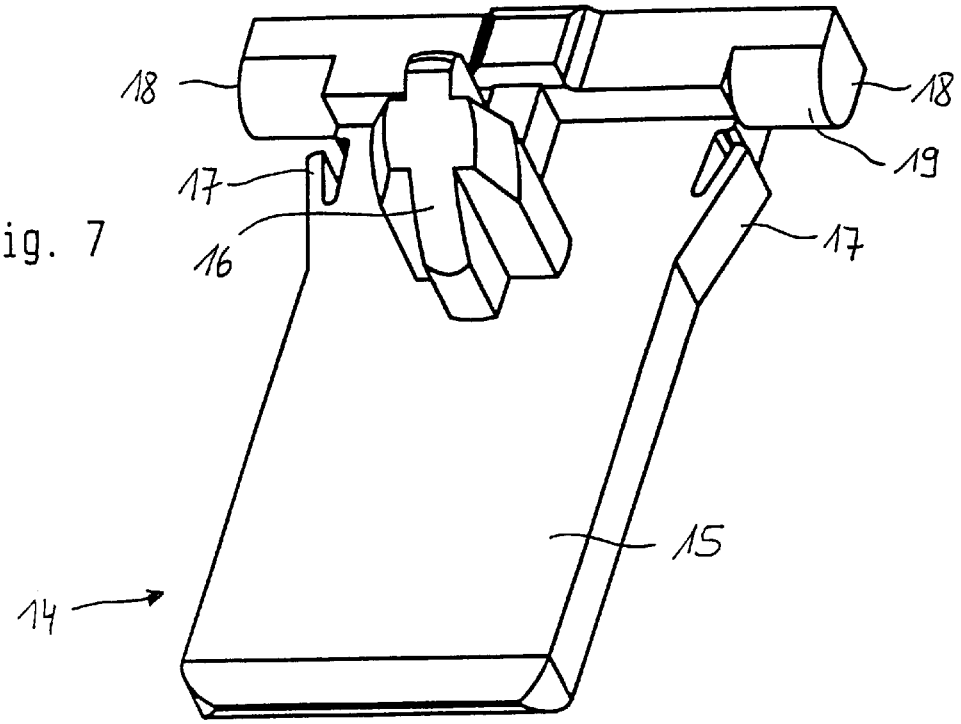
FIG. 7: shows a perspective view of a latch connector from above.
Figure 8:
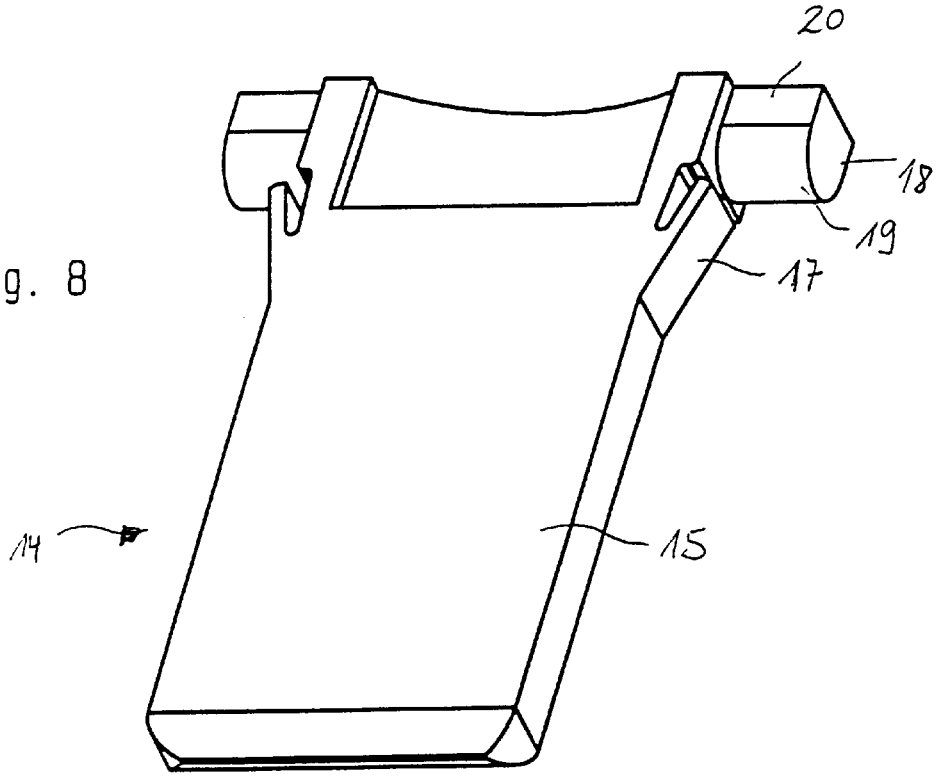
FIG. 8: shows a perspective view of a latch connector from below.

As especially shown in FIGS. 7 and 8, the latch connector (14) is a basically flat rectangular-shaped component and has a dowel plug (16) that stands up somewhat perpendicular from the latch connector's (14) flat surface. This dowel plug (16) is to be inserted into the corresponding blind hole (12) of the drawer bottom (11) after the latch connector (14) is inserted and the drawer bottom is placed. Therefore, this makes it possible that the notch (10) in the supporting flange (8) reaches up to the blind hole (12) area, so that the dowel plug (16) can be pressed in by rotating the latch connector (14) through the notch (10) through the blind hole (12). On one side the latch connector (14) has an axle journal (18) (which as already been described above) that extends parallel to the latch connector's surface and projects over its wide side.

Positional stability and a certain catch action of the closed latch connector (14) are achieved by the resilient clips (17) which are located opposite the axle journal on the latch connector's (14) flanks. In the latch connector's (14) open position, these brackets (17) fit resiliently on the flange's (4) horizontal section (6). In the latch connector's (14) closed position, the clips (17) fit resiliently on the flange's (4) vertical section (7). The axle journal (18) always fits on the clip's (17) opposite section's (6) surface, or respectively, on the section's (7) surface, and produce the necessary opposing support. The clips are made and placed on the latch connectors (14) so that when the latch connectors are placed in the notch (10), they do not encounter any resistance, and slide through the notch and fit, locking, on the flange (4).

Figure 5:
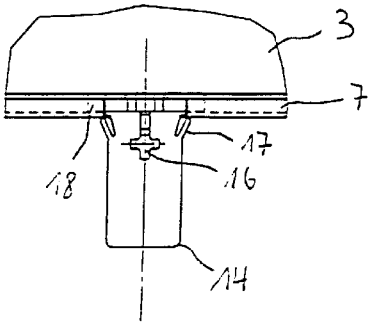
FIG. 5: shows a top view of the layout, according to FIG. 3 in the arrow direction V.

According to FIGS. 3 and 5, the latch connector (14) is then shown in its open position; that is, the latch connector's (14) handle (15) projects, in relation to the drawer bottom (11), perpendicular and downward. The latch connector can manually be pivoted in the arrow direction (21) about 90° in the direction of the drawer bottom (11), so that the dowel plug (16) reaches contact with the drawer bottom's (11) blind hole (12). The dowel plugs and blind holes are designed so that it requires a certain amount of force to press in the dowel plugs, resulting in a firm, secure, and form-fitting connection. The swinging action of the latch connector (14) is made easier since its axle journal (18) has a cylindrical rolling surface (19) on a part of its perimeter, and this rolling surface rolls on the horizontal section (6) of the flange.

Figure 6:
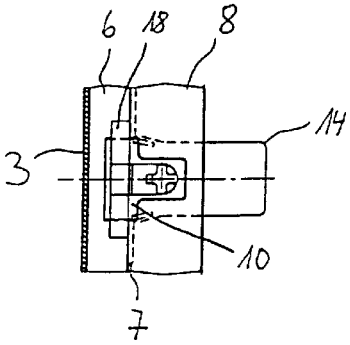
FIG. 6: shows a section through the layout, according to FIG. 4 along Line VI—VI.

It is evident in FIGS. 4 and 6 that, the latch connector (14) in its closed position, is level with its axle journal's (18) rolling surface (19), and finally, a catch surface (20), which rests on the flange's (4) horizontal section (6); the latch connector (14) is held in the closed position with the aid of the resilient link (17).

It is also evident in FIG. 7, that the dowel plug (16) is preferably not cylindrical or rectangular in shape, but has a profiled form on which the dowel plug is preferably slanted. This feature makes pressing the dowel plug (16) in the drawer bottom's (11) blind hole (12) easier.

An advantage of the invention is that the latch connector's (14) connection between the Zargen drawer slide system (1) and the drawer bottom (11) can be released quickly and easily without tools. The latch connector (14) is opened manually towards the arrow direction (21); this releases the drawer bottom's (11) connection to the Zargen drawer slide system (1) and allows it to be removed. If necessary, the latch connector (14) can, likewise, be released from the Zargen drawer slide system by pressing the resilient clip (17) by hand, which allow the latch connector (14) to be removed from its seat in the Zargen drawer slide system (1).

Drawing legend

1 Zargen drawer slide system
2 Zargen drawer slide component (inner)
3 Zargen drawer slide component (outer)
4 Flange (Z-shaped)
5 Groove
6 Section (horizontal)
7 Section (vertical)
8 Supporting flange
9 Lip
10 Notch
11 Drawer bottom
12 Blind hole
13 Back panel
14 Latch connector
15 Handle
16 Dowel plug
17 Clip (resilient)
18 Axle journal
19 Rolling surface
20 Catch surface
21 Arrow direction

I claim:

1. Drawer with a drawer slide system, which simultaneously functions as a side wall of the drawer and which drawer slide system has a horizontal flange that supports and holds a drawer bottom, and a fastener that connects the drawer slide system to the drawer bottom, wherein the improvement comprises:

a latch connector that is anchored, swinging, in the drawer slide system and that can be manually engaged and disengaged in and out of a corresponding notch in the drawer bottom;

the latch connector being formed as a basically flat and rectangular shaped component;

the latch connector having a flat side from which is formed a somewhat perpendicular projecting dowel plug;

the notch in the drawer bottom being formed as a blind hole;

the drawer slide system having a notch into which the latch connector is inserted;

the latch connector being anchored in the drawer slide system by an axle journal located on an end of the latch connector, with the axle journal resting on a groove formed by sections of the drawer slide system;

the latch connector having a handle, and the axle journal having a cylindrical rolling surface which graduates into a level catch surface; and the latch connector having opposing resilient clips that are supported and held on the sections of the drawer slide system when the latch connector is engaged in the drawer bottom notch and disengaged out of the drawer bottom notch.

2. Drawer, according to claim 1, wherein the improvement further comprises the dowel plug having a profiled shape and a free end which is slanted.

3. A drawer assembly comprising:

a first drawer component having portions defining a notch and a groove associated with the notch;

a latch component pivotally anchored to the first drawer component and insertable into the notch, wherein a portion of the latch component abuts the groove;

a dowel plug projecting from the latch component;

a second drawer component having portions defining a hole, the latch component being pivotal on the first drawer component from a position with the dowel plug spaced from the hole to a position with the dowel plug engaged in the hole;

wherein said first drawer component is securable to said second drawer component by engagement of the dowel plug in the hole.

4. The drawer assembly according to claim 3, wherein the portion of the latch component resting on the groove further comprises an axle journal formed on an end of the latch component.

5. The drawer assembly according to claim 4, wherein the axle journal has a cylindrical rolling surface which graduates into a flat catch surface.

6. The drawer assembly according to claim 5, wherein the latch component has resilient clips disposed on opposing sides of the latch component which urge against sections of the first drawer component adjacent the notch.

* * * * *